United States Patent [19]

Scott

[11] 4,012,913

[45] Mar. 22, 1977

[54] FRICTION ROCK STABILIZERS

[76] Inventor: James J. Scott, Lecoma Star Rte., Rolla, Mo. 65401

[22] Filed: Oct. 3, 1975

[21] Appl. No.: 619,214

[52] U.S. Cl. ..... 61/45 B; 85/8.3

[51] Int. Cl.[2] ..... E21D 21/00; E21D 20/00

[58] Field of Search ..... 61/45 B, 63, 45 R; 85/84, 63, 32.1, 80, 8.3

[56] References Cited

UNITED STATES PATENTS

| | | | |
|---|---|---|---|
| 2,754,716 | 7/1956 | Bourns | 85/8.3 |
| 3,227,030 | 1/1966 | Preziosi et al. | 85/8.3 X |
| 3,557,402 | 1/1971 | Koehl | 85/8.3 X |
| 3,630,261 | 12/1971 | Gley | 85/8.3 X |
| 3,913,444 | 10/1975 | Otte | 85/8.3 |
| 3,922,867 | 12/1975 | Scott | 61/45 B |

FOREIGN PATENTS OR APPLICATIONS

| | | | |
|---|---|---|---|
| 267,978 | 4/1968 | Austria | 85/8.3 |
| 665,491 | 6/1965 | Belgium | 85/8.3 |
| 486,025 | 8/1952 | Canada | 85/8.3 |

*Primary Examiner*—Dennis L. Taylor
*Attorney, Agent, or Firm*—Bernard J. Murphy

[57] ABSTRACT

Friction rock stabilizers for anchoring a structure such as a roof or side wall of a mine shaft or other underground opening, comprising a generally annular body having longitudinally extending edge portions which overlap one another circumferentially of the body and are relatively movable to permit substantial circumferential compression of the body. The body is circumferentially compressed for installation in a bore of diameter substantially smaller than the normal maximum outer diameter of the body whereby, after such installation, the resilience of the body causes the body outer circumference to anchor by frictional engagement with the surrounding wall of the bore.

13 Claims, 8 Drawing Figures

FRICTION ROCK STABILIZERS

The present invention relates to the anchoring of a structure such as a roof or side wall of a mine shaft or other underground opening, and more specifically to the provision of new and improved friction rock stabilizers particularly adapted for said anchoring of a structure such as a roof or side wall of a mine shaft or other underground opening.

My co-pending U.S. Pat. application Ser. No. 520,310 filed Nov. 4, 1974, discloses friction stabilizers of the general type to which this invention is directed.

An object of the present invention is to provide a new and improved friction stabilizer particularly constructed and arranged to maximize the permissible dimensional tolerances of the bore in which the stabilizer is to be installed.

Another object of the invention is to provide a new and improved friction stabilizer particularly constructed and arranged to insure that, when installed, it forms a complete annulus or ring without gap or space through its thickness.

Other objects and advantages of the invention will become apparent from the following description taken in connection with the accompanying drawings wherein, as will be understood, the preferred embodiments of the invention have been given by way of illustration only.

In accordance with the invention, a friction stabilizer may comprise a generally annular body having longitudinally extending portions which overlap circumferentially of the body, the body being of dimension predetermined to be substantially larger than the diameter of the bore in which it is to be inserted such that insertion of the body in such bore causes substantial circumferential compression of the body, the overlapping portions of the body being relatively movable circumferentially of the body to permit such substantial circumferential compression of the body, the stabilizer being free of structure precluding such substantial circumferential compression of the body, and the body being of material permitting such substantial compression during its said insertion and, after such insertion, causing the body outer circumference to frictionally engage the wall of the bore for frictionally anchoring the structure.

Referring to the drawings.

Figure 2:
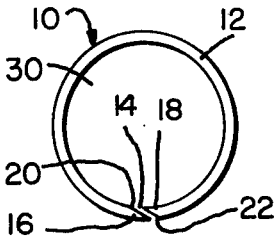
FIG. 2 is a top or plan view of the stabilizer illustrated in FIG. 1.
Figure 1:
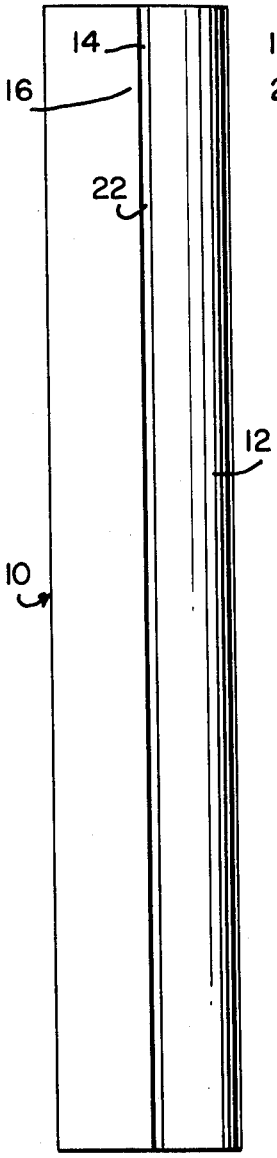
FIG. 1 is an elevational side view of one stabilizer constructed in accordance with the present invention.

Referring more particularly to the drawings wherein similar reference characters designate corresponding parts throughout the several views, FIG. 1 and 2 illustrate one embodiment of the invention in the form of a friction rock stabilizer, designated generally as 10, in normal uncompressed condition prior to its installation in a pre-formed bore in the roof, side wall or other structure to be anchored. The stabilizer 10 comprises an elongated, generally annular body 12 which is open ended and longitudinally split or slotted to include a single slot 14 through its thickness from end-to-end, or throughout the length, of the body 12. The slot 14 is angled to extend generally circumferentially of the body 12 rather than constructed radially therethrough, thus causing the body 12 throughout its length to include longitudinally extending edge portions 16,18 which overlap one another circumferentially of the body 12 and terminate in opposed angled edges 20,22, extending at least generally longitudinally of the body 12, on opposite sides of the slot 14. As shown in FIG. 2, the edges 20,22 are formed at identical angles to a radial plane through the thickness of the body 12; and, as will be understood, the described angling of the edges 20,22 causes such to be readily slidable one over the other during circumferential compression of the body 12 and thereby facilitates movement of the edge portions 16,18 relative to one another during such circumferential compression. The body 12 is formed of a single material thickness and defines inner and outer walls which have a common discontinuity formed by slot 14. The slot, as noted, extends uniformly throughout the full length of the body, and this is seen particularly in FIG. 1. The discontinuity (defined by the slot) in the inner wall is spaced, circumferentially of the body, from the discontinuity in the outer wall. This arises due to the fact that the slot 14 is formed generally tangentially to the body 12. Additionally, the body is formed of a material having a uniform thickness and, therefore, in its static or free state, the body defines inner and outer walls which have a common annular configuration.

The body 12 is (except for the slot 14) imperforate, generally cylindrical and of constant outer diameter from end-to-end, it being understood, however, that the outer diameter of the body forward or leading end (that is, the end of the body 12 intended to be first inserted in the pre-formed bore) could be of slightly lesser outer diameter than the remainder of the body 12 to facilitate such insertion. The ratio of the length of the body 12 to the maximum outer diameter thereof is at least about 16 to 1 and preferably about 32 to 1 or 48 to 1, it being understood however that such longer stabilizers could be constructed of interconnected segments each of the mentioned 16 to 1 ratio or greater. The outer circumferential dimension of the body 12 is greater than about two inches.

The body 12 is constructed of steel, thus permitting its substantial circumferential compression for insertion in a substantially smaller diameter bore and, after such insertion, causing the body outer circumference to frictionally engage the surrounding wall of the bore for anchoring a structure such as the roof of a mine shaft. Also, as will be noted, the anchor 10 is entirely free of structure precluding such substantial circumferential compression of the body 12, the interior of the body 12 being open or empty. The outer diameter of the body 12 of the stabilizer 10 for installation in any given size bore is predetermined to be substantially larger than the diameter of the bore; and the ratio of the radial thickness of the body 12 to the body maximum outer diameter is no greater than about 1 to 5 and no less than about 1 to 50, thereby permitting plastic deformation of the body 12 during its insertion in the bore.

The beforedescribed stabilizer 10 can be readily constructed from tubular stock by merely forming or cutting the angled slot 14 through the thickness of the stock throughout its length. Also, as the precise width of the slot 14 is not critical to the anchoring to be performed by the stabilizer 10 due to the described relationship of the edge portions 16,18, such width can be varied within a relatively wide range and, if desired, the stabilizer can even be circumferentially compressed during its formation to dispose the edges 20,22 of the edge portions 16,18 in abutting relationship. Also, if desired, the stabilizer 10 may be formed of sheet material rolled to the illustrated configuration either with the edges 20,22 spaced apart by the described slot 14 or in abutting relationship.

Figure 4:
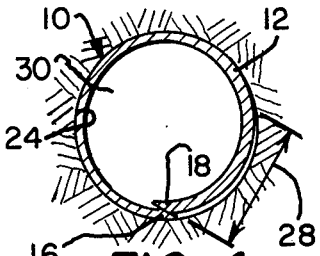
FIG. 4 is a sectional view of such installed stabilizer taken on line 4—4 of FIG. 3, looking in the direction of the arrows.
Figure 3:
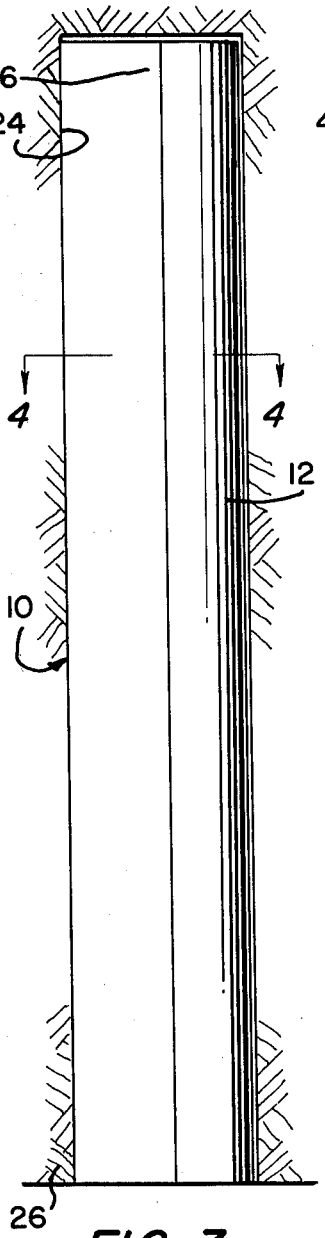
FIG. 3 is an elevational side view showing the stabilizer of FIG. 1 installed in a bore formed in a roof of a mine shaft or other underground opening.

FIGS. 3 and 4 illustrate the stabilizer 10 of FIGS. 1 and 2 in installed condition in a pre-formed bore 24 in a mine or tunnel roof or other structure 26 to be anchored thereby, it being understood that, as beforedescribed, the diameter of the bore 24 is substantially smaller than the normal, uncompressed outer diameter of the body 12 of the stabilizer 10. The stabilizer 10 is installed in the bore 24 by substantially circumferentially compressing the body 12 such that the body 12 is formed plastically (that is deformed into the plastic range and beyond the elastic range), and thence longitudinally inserting the compressed body 12 into the bore 24. During such plastic deformation of the body 12, the edges 20,22 of the edge portions 16,18 slide over one another to increase the circumferential overlapping of the edge portions 16,18; and, after insertion of the body 12 in the bore 24, the resilence of the body 12 causes the body outer circumference to frictionally engage the surrounding wall of the bore 24 throughout the length of the body 12 and, aside from a minor portion 28 of its outer circumference, throughout the outer circumference of the body 12. The stabilizer 10 anchors by this frictional engagement of the outer circumference of the body 12 with the wall of the bore 24, the edge portions 16,18 being during this anchoring in the relationship shown in FIG. 4, whereby the body 12 forms a complete annulus or ring completely circumferentially enclosing the opening 30 therein and without gap or space through its radial thickness. Also, as shown in FIG. 3, the stabilizer body 12 is of length to extend at least substantially throughout the length of the bore 24, or alternatively a plurality of end-to-end stabilizers 10 are disposed in the bore 24 and interconnected with their bodies 12 cooperating to extend at least substantially the length of the bore 24, whereby such frictional engagement occurs at least substantially throughout such length of the bore 26.

FIGS. 5 through 8 illustrate a second embodiment of the invention in the form of a friction rock stabilizer 32 which is different from the beforedescribed stabilizer 10 only in the relative arrangement of the overlapping portions of the stabilizer body.

Figure 6:
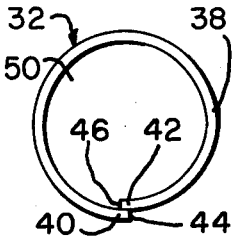
FIG. 6 is a top or plan view of the stabilizer shown in FIG. 5.
Figure 8:
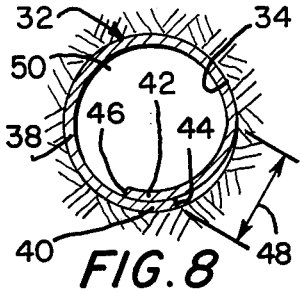
FIG. 8 is a sectional view of the stabilizer of FIG. 7 taken on line 8—8 of FIG. 7, looking in the direction of the arrows.
Figure 5:
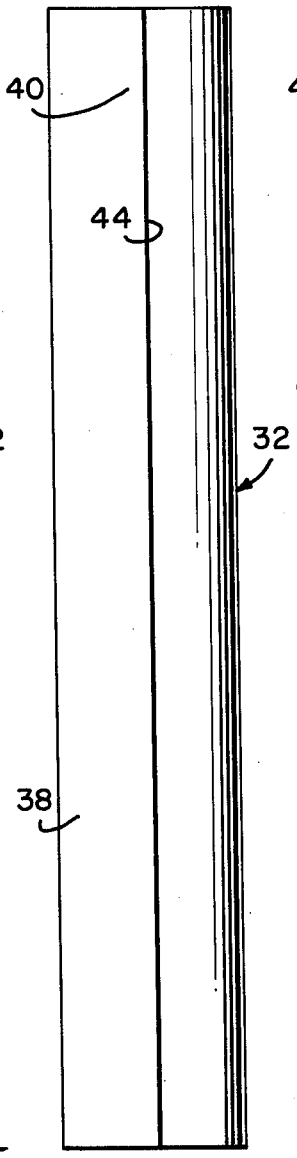
FIG. 5 is an elevational side view of a second stabilizer constructed in accordance with the invention.
Figure 7:
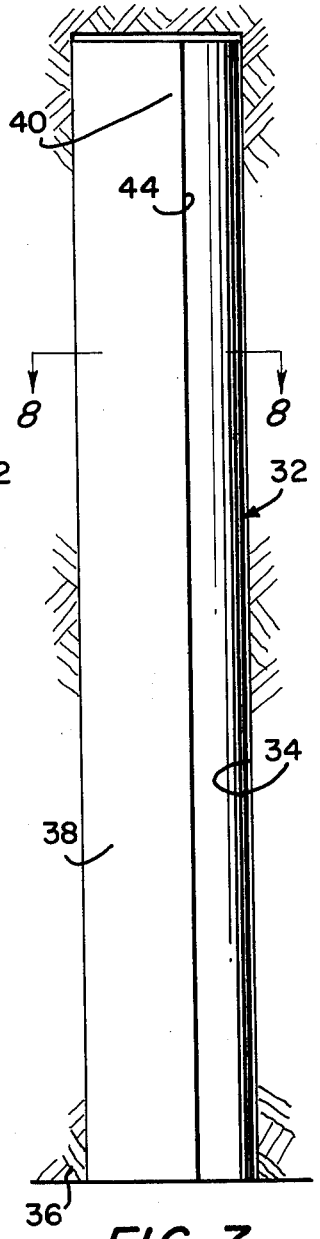
FIG. 7 is an elevational side view showing the stabilizer of FIG. 5 installed in a bore formed in a roof of a mine shaft or other underground opening.

FIGS. 5 and 6 illustrate the stabilizer 32 in normal, uncompressed condition prior to its installation in a pre-formed bore in the structure to be anchored; and FIGS. 7 and 8 illustrate such stabilizer 32 in anchoring position in a pre-formed bore 34 in the mine roof or other structure 36 to be anchored. As shown in FIGS. 5 and 6, the stabilizer 32 comprises an elongated, generally annular, open ended body 38 which throughout its length includes longitudinally extending edge portions 40,42 slidably overlapping one inside the other circumferentially of the body 30. The edges 44,46 of the edge portions 40,42, respectively, of course, may be of any desired configuration and, as shown in FIG. 6, are offset circumferentially of the body 30 with the stabilizer 32 in normal, uncompressed condition. The body 38 is, as will be understood, constructed of steel permitting its substantial circumferential compression for insertion in a substantially smaller diameter bore and after such insertion causing the body outer circumference to frictionally engage the surrounding wall the bore for anchoring the structure containing the bore. The stabilizer 32 is, as again will be understood, entirely free of structure precluding said circumferential compression of the body 38; and the interior of the body 38 is entirely open or empty. Also, the outer diameter of the body 38 of the stabilizer 32 for any given size bore is again predetermined to be substantially larger than the diameter of the bore; and the ratio of the radial thickness of the material of the body 38 to the body maximum outer diameter is no greater than about 1 to 5 and no less than about 1 to 50, thereby permitting plastic deformation of the body 38 during its installation in such a bore. Furthermore, the dimensional relationship or ratio of the length of the body 38 to the maximum outer diameter thereof is the same as that beforedescribed for the stabilizer 10; and the minimum outer circumferential dimension of the body 38 is at least two inches.

The anchoring of the structure 36 by the stabilizer 32 proceeds in the same manner beforedescribed for the anchoring of the structure 26 by the stabilizer 10 and hence is believed to be readily apparent from the beforegiven description of the anchoring of the structure 26 by such stabilizer 10, it being understood that during such anchoring the body 38 is plastically deformed and the edge portions 40,42 are moved circumferentially of the body 38 from their relative positions shown in FIG. 6 to their relative positions shown in FIG. 8. The installed stabilizer 32 frictionally anchors for all but the minor portion 48 of its outer circumference throughout its length. The opening 50 longitudinally through the stabilizer body 38 is, as will be noted from FIGS. 6 and 8, at all times completely circumferentially enclosed by the body 38; and the installed stabilizer 32 hence includes no gap or space through its radial thickness.

From the preceding description, it will be seen that the invention provides new and improved friction stabilizers for accomplishing all of the beforestated objects of the invention. It will, moreover, be seen that during the anchoring of a structure by either of the beforedescribed stabilizers 10,32, their beforedescribed respective edge portions slide over one another circumferentially of the stabilizer body. Also, after installation, and during the anchoring, such overlapping edge portions establish a hoop stress in the stabilizer body to increase the normal force against the side of the bore, thereby increasing the normal force against the wall of the bore and also increasing the anchoring force. It will be understood that the overlapping edge portions of the stabilizers 10,32 may, if desired, be roughened on their opposing surfaces to increase friction between them and thereby increase the mentioned hoop stress; and it will also be seen that the stabilizer bodies are deformed plastically and frictionally engage the wall of the bore over most of their outer circumference, the plastic deformation in the area of the overlapping edge portions being, of course, the most severe.

It will be understood however that, although only two embodiments of the invention have been illustrated and hereinbefore specifically described, the invention is not limited merely to these two embodiments but rather encompasses other embodiments and variations within the scope of the following claims.

Having thus described my invention, I claim:

1. A friction stabilizer for installation in a structure such as a roof or side wall of a mine shaft or other underground opening for anchoring the structure, said stabilizer comprising a generally annular body having longitudinally extending portions which overlap circumferentially of said body, said body being of dimension predetermined to be substantially larger than the diameter of the bore in which it is to be inserted such that insertion of said body in such bore causes substantial circumferential compression of said body, said overlapping portions of said body being relatively movable circumferentially of said body to permit such substantial circumferential compression of said body, the stabilizer being free of structure precluding said substantial circumferential compression of said body, and said body being of material permitting its said substantial compression during its said insertion and, after such insertion, causing the body outer circumference to frictionally engage the wall of the bore for frictionally anchoring the structure and wherein said body is defined by inner and outer circumferential walls formed of a single thickness of said material, which inner and outer walls, in cross-section, are of common annular configuration; said inner and outer walls each having a prescribed, common discontinuity which extends, uniformly, fully longitudinally of said body; and said discontinuities of said inner and outer walls are spaced apart, one from the other thereof, circumferentially of said body.

2. A friction stabilizer according to claim 1, wherein said overlapping portions of said body extend throughout the length of said body and include edges extending at least generally longitudinally of said body.

3. A friction stabilizer according to claim 2, wherein said edges of said overlapping portions are in opposed relationship.

4. A friction stabilizer according to claim 3, wherein said edges of said overlapping portions are angled to facilitate their movement over one another during relative movement of said overlapping portions occasioned by substantial circumferential compression of said body.

5. A friction stabilizer according to claim 4, wherein said edges of said overlapping portions are spaced apart by a longitudinal slot through said body.

6. A friction stabilizer according to claim 2, wherein said edges of said overlapping portions are offset circumferentially of said body.

7. A friction stabilizer according to claim 2, wherein the ratio of the length of said body to the maximum outer diameter thereof is at least about 16 to 1, the ratio of the radial thickness of said body to the maximum outer diameter thereof is at a maximum about 1 to 5 and at a minimum about 1 to 50, and the outer circumferential dimension of said body is at least two inches.

8. A friction stabilizer according to claim 7, wherein said body is dimensioned to be plastically deformed during its insertion in the bore and is of material permitting such plastic deformation during such insertion, and the stabilizer is free of structure precluding such plastic deformation.

9. A friction stabilizer according to claim 8, wherein said edges of said overlapping portions are angled to facilitate their movement over one another during relative movement of said overlapping portions occasioned by substantial circumferential compression of said body.

10. A friction stabilizer according to claim 9, wherein said edges of said overlapping portions are spaced apart by a longitudinal slot through said body.

11. A friction stabilizer according to claim 8, wherein said edges of said overlapping portions are in opposed relationship.

12. A friction stabilizer according to claim 8, wherein said edges are offset circumferentially of said body.

13. A friction stabilizer according to claim 1, wherein the ratio of the length of said body to the maximum outer diameter thereof is at least about 16 to 1, the ratio of the radial thickness of said body to the maximum outer diameter thereof is at a maximum about 1 to 5 and at a minimum about 1 to 50, and the outer circumferential dimension of said body is at least two inches.

* * * * *